United States Patent [19]

Sacks et al.

[11] Patent Number: 4,704,763

[45] Date of Patent: Nov. 10, 1987

[54] WRINGER FOR MOPS AND THE LIKE

[75] Inventors: Dieter Sacks, Uerikon; Hans Mönch, Küsnacht, both of Switzerland

[73] Assignee: Interpat Limited, London, England

[21] Appl. No.: 796,015

[22] Filed: Nov. 7, 1985

[30] Foreign Application Priority Data

Nov. 9, 1984 [DE] Fed. Rep. of Germany ..... 3440924

[51] Int. Cl.[4] ..... A47L 13/58

[52] U.S. Cl. ..... 15/262; 15/260

[58] Field of Search ..... 15/260, 261, 262

[56] References Cited

U.S. PATENT DOCUMENTS

| | | | |
|---|---|---|---|
| 1,922,981 | 8/1933 | Robertson | 15/262 |
| 2,067,001 | 1/1937 | Palmieri | 15/262 |
| 2,615,191 | 10/1952 | Brown | 15/262 |
| 4,620,340 | 11/1986 | Bohacek | 15/261 |

*Primary Examiner*—Chris K. Moore

*Attorney, Agent, or Firm*—Peter K. Kontler

[57] ABSTRACT

The plate-like carrier for the absorbent part of a mop is located in a vertical plane while a roller or a blade is caused to move along and in linear contact with successive increments of the absorbent part, either vertically from the upper edge to the lower edge or horizontally from one end to the other end of the carrier. The roller or blade can be moved by a manually operated drive or by a motor through the medium of a carriage.

48 Claims, 8 Drawing Figures

2a
2
2a
3
4
2a
5
5a 1
21
6
25
34
30
33
212
36
14
112
14
36
12
29
13
19
III
11
15
III
36
14
36
18
14
25
21

WRINGER FOR MOPS AND THE LIKE

CROSS-REFERENCE TO RELATED CASE

The apparatus of the present invention is related to the apparatus which is disclosed in our copending patent application Ser. No. 798,482 filed Nov. 15, 1985 for "Apparatus for wringing the strands of mops".

BACKGROUND OF THE INVENTION

The present invention relates to apparatus for expelling moisture from mops and like implements wherein a rigid or substantially rigid carrier supports an absorbent body of foam rubber, filamentary textile or other deformable material. More particularly, the invention relates to improvements in apparatus which can be used with advantage as mop wringers.

It is well known to expel dirty water from the strands of a mop by pressing the strands against a perforated plate so that the accumulated moisture can descend under the action of gravity by flowing through the perforated plate. A drawback of such apparatus is that the operator must apply a pronounced force (e.g., to an elongated handle) in order to urge the carrier against the strands and to thus press the moisture-laden strands against the upper side of the plate. The extent to which the moisture (and hence the dirt) is expelled from the strands depends on the magnitude of the applied force and on the orientation of the carrier relative to the plate while the latter is in contact with the strands. Moreover, solid and/or other contaminants which are expelled from the strands are likely to gather at the upper side of the plate (on the unperforated portions of such plate) so that they are entrained and retained by the strands when the wringing operation is completed.

OBJECTS AND SUMMARY OF THE INVENTION

An object of the invention is to provide a novel and improved apparatus for expulsion of moisture from the deformable body of a mop or a like implement in such a way that each and every portion of the deformable body can be relieved of moisture and of dirt to the same extent as well as that the expulsion of a high percentage of moisture can be effected with the exertion of a minimal effort or no effort at all.

Another object of the invention is to provide an apparatus which can be manipulated by unskilled persons and whose manipulation does not necessitate the exertion of a pronounced force or which can be manipulated without the exertion of any forces on the part of the operator.

A further object of the invention is to provide the apparatus with novel and improved means for predictably locating the implement preparatory to and during expulsion of moisture and contaminants from the deformable body.

An additional object of the invention is to provide an apparatus which is constructed and assembled in such a way that the contaminants exhibit a pronounced tendency to leave the deformable body as soon as the latter is subjected to a deforming stress.

Still another object of the invention is to provide the apparatus with novel and improved means for ensuring that the implement is automatically advanced to an optimum position for expulsion of large quantities of moisture from the deformable body while the implement is in the process of moving toward the position it occupies in the course of the wringing operation.

Another object of the invention is a simple, compact and inexpensive apparatus which can be designed to treat all types of mops and analogous moisture gathering implements, and which can be designed or adjusted to apply to the moisture gathering body a selected deforming force.

An additional object of the invention is to provide the apparatus with novel and improved wringing or deforming means.

The invention is embodied in an apparatus for expelling moisture from mops and like implements wherein a carrier (e.g., an elongated plate-like rectangular carrier) supports a body of deformable absorbent material (such body can constitute a sponge, it may consist of or comprise elongated strands or it may include other material or materials which absorb water, e.g., during sweeping of floors or the like). The apparatus comprises a support including means for locating the carrier of an implement in a predetermined position (e.g., in such a way that the plate-like carrier is located in a substantially vertical plane and extends substantially horizontally), wringing means movably carried by the support, and means for moving the wringing means along a predetermined path relative to a carrier which occupies the predetermined position so that the wringing means is maintained in a substantially linear contact with and deforms successive increments of the body on such carrier while the wringing means moves along at least one portion of its predetermined path. The apparatus preferably further comprises an abutment for the wringing means, and the latter is then disposed between the deformable body on the carrier (which occupies the predetermined position) and the abutment during movement along the aforementioned portion of the path.

The wringing means can comprise one or more rotary elements (e.g., an elongated roller) whose axis or axes extend substantially transversely of the predetermined path. The moving means then preferably includes means for rolling the rotary element or elements along the deformable body during movement along the one portion of the path.

The locating means preferably includes means for maintaining the carrier (which occupies the predetermined position) in a substantially vertical plane, and the one portion of the predetermined path for the wringing means is preferably at least substantially vertical. The support preferably further comprises a housing for the locating means, and the apparatus preferably further comprises means for guiding a carrier during manual insertion (e.g., by means of a handle) into the housing on the way toward the predetermined position. Such means for guiding the carrier can constitute an integral part of the locating means or vice versa. The wringing means is preferably movable to and from a starting position in which the wringing means and the means for guiding the carrier define a channel wherein the implement is advanced in order to locate its carrier in the predetermined position. The orientation of the channel is preferably such that the inclination of the carrier changes on its way toward and from the predetermined position, for example, so that the carrier is substantially horizontal at least during the initial stage of its travel through the channel and is substantially vertical when it reaches and assumes the predetermined position. The locating means can be provided with a substantially vertical exposed surface which is contacted by the carrier when the latter assumes the predetermined position, and the aforementioned means for guiding the carrier can be provided with a second surface which is located at a level above and slopes downwardly toward the exposed surface of the locating means.

If the carrier is rigidly or articulately connected to one end of an elongated handle, the means for guiding the carrier is preferably provided with a slot which receives a portion of the handle while the corresponding carrier is maintained in the predetermined position and which can also receive a portion of the handle while the carrier is in the process of moving toward or away from its predetermined position. The locating means and the means for guiding the carrier are preferably elongated and at least substantially parallel to each other, and the slot is preferably disposed midway between the ends of the means for guiding the carrier so as to ensure convenient guidance of a carrier whose median portion is attached to one end of the handle in a manner well known from the field of mops, floor scrubbing brushes and the like. The upper end of the slot is preferably open.

The aforementioned path for the wringing means includes the one portion (along which the wringing means advances while it is maintained in substantially linear contact with the deformable body), and such path can further comprise a second portion along which the wringing means advances on its way toward and away from engagement with the deformable portion and which has a preferably closed end to determine the starting or idle position of the wringing means. If the wringing means includes at least one roller or an analogous rotary element, it is nearer to the locating means during movement along the one portion of the path and is more distant from the locating means during movement along the second portion of the path. The second portion of the path can be located at a level above the one portion. If the carrier and the deformable body thereon are elongated, the length of a wringing means including a roller or the like preferably matches or even exceeds the length of the carrier. The support then preferably comprises means for confining the end portions of the elongated wringing means to movements along the predetermined path, and such confining means can be provided with passages (e.g., in the form of inverted L-shaped slots) for the end portions of the wringing means. The end portions of the wringing means can include or constitute stub shafts, and the moving means can comprise means for transmitting motion to the shafts. Such motion transmitting means can comprise one or two toothed racks, and the moving means then further comprises a pinion for each of the racks. Such pinions are rotatably mounted on the support and mate with the respective racks, and the moving means further comprises means (e.g., an elongated lever which is rigidly connected to an elongated shaft whose end portions, in turn, are rigidly connected to the pinions) for rotating the pinions. The confining means can comprise two spaced-apart substantially vertical sidewalls or cheeks, and the wringing means (e.g., a roller) then further comprises a main or central portion which is disposed between the two sidewalls and is flanked by the two stub shafts. The stub shafts extend outwardly through the passages of the respective sidewalls and the aforementioned toothed racks are then outwardly adjacent to the respective sidewalls and have elongated closed slots for portions of the respective stub shafts. Each toothed rack can comprise a substantially vertical first leg which is provided with a row of teeth, and a second leg which is inclined relative to and is located at a level below the first leg. The closed slots are provided in the second legs of the respective toothed racks, and the support is provided with suitable guides for the first legs of the racks. Each of the inverted L-shaped passages preferably includes a substantially horizontal shorter upper portion and a substantially vertical longer lower portion. Each shorter portion has a closed end which is remote from the respective longer portion, and each of the closed slots has a lower end portion which is in substantial register with the closed end of the respective shorter portion and an upper end portion which is in substantial register with the respective longer portion while the corresponding toothed rack is held in an upper end position corresponding to the starting position of the wringing means. The closed slots are preferably elongated and preferably extend at angles of approximately 45 degrees to the shorter and longer portions of the respective passages.

The shaft for the two pinions is preferably journalled in the sidewalls which constitute or include the confining means. The lever which is used to rotate the pinions by way of their shaft is preferably vertical or nearly vertical in the starting position of the wringing means and is preferably horizontal or nearly horizontal when the wringing means is about to enter or has entered the one portion of its path.

The apparatus can further comprise means for yieldably biasing the wringing means against the deformable body on the carrier which occupies the predetermined position while the wringing means is located in the one portion of the path. The biasing means can comprise springs which act against the aforementioned stub shafts of roller-shaped wringing means and urge the median or main portion of such wringing means against the deformable body on the adjacent carrier. Alternatively, or in addition to the provision of such springs, the wringing means can include an elastic portion which contacts the deformable body on the carrier occupying the predetermined position while the wringing means is located in the one portion of its path. For example, if the wringing means comprises a roller, the latter can include a rigid core (such core can include or it can be connected with the aforediscussed stub shafts) and the elastic portion of such roller can constitute or include a sleeve surrounding the core.

The moving means can comprise means (such as the aforementioned motion transmitting toothed racks, pinions and means for rotating the pinions) for positively moving the wringing means from one end toward the other end of the predetermined path, particularly away from the starting position of the wringing means), and means for yieldably urging the wringing means back to the one end of the path. The one end of the path can be located at a level above the other end so that the wringing means moves downwardly while it is maintained in linear contact with successive increments of the deformable body on the carrier occupying the predetermined position, and the urging means can comprise at least one coil spring or other suitable resilient means. The resilient means can act upon and can be at least partially confined in the aforementioned toothed racks of the moving means.

The locating means can include at least one reinforcing portion so that it can stand the stresses which are applied thereto by the carrier for a deformable body which is being squeezed by the wringing means. If the locating means includes or constitutes a substantially plate-like locating member having a first side which is contacted by the carrier occupying the predetermined position and a second side facing away from such carrier, the reinforcing means can comprise one or more longitudinally and/or transversely and/or otherwise extending ribs at the second side of the locating member.

The locating means can comprise a portion (e.g., one or more platforms or ledges) on which the carrier of an implement comes to rest while it occupies the predetermined position.

It is also possible to employ wringing means in the form of a wiper, a blade or an analogous deforming member having an elongated edge which is in linear contact with the deformable body on a carrier which is held in the predetermined position while the wringing means is caused to advance along its path. If the carrier is elongated and is substantially horizontal, while in the predetermined position, the moving means can include means for moving the deforming member substantially horizontally from one toward the other end of the carrier. The width of the deformable body on the carrier which occupies the predetermined position can match or approximate the length of the edge on the deforming member and the edge can extend transversely of the longitudinal direction of the carrier while the deforming member is caused to advance along its path to expel moisture and dirt or the like from successive increments of the deformable body.

The moving means can comprise a prime mover, e.g., an electric motor which can be driven by a preferably rechargeable battery mounted directly on the support or on a part which, in turn, is mounted on the support. The moving means can include a manually or motorically reciprocable carriage which is guided by the support and supports the wringing means, e.g., the aforementioned blade-like deforming member. For example, the support can include a partition which is formed with an elongated slot for a portion of the carriage, one side of which faces the deformable body on the carrier which occupies the predetermined position and the other side of which faces away from such carrier. The prime mover can include a reversible motor disposed at the other side of the partition and including a shaft or another suitable output element for a pinion in mesh with a rack which is mounted on the partition and extends along the slot. The output element can drive the pinion through the medium of a suitable transmission, e.g., a step-down transmission including a set of mating gears. The carriage can be attached to the motor so that it shares the movements of the motor along the partition in response to rotation of the pinion in a clockwise or in a counterclockwise direction. The wringing means is then located between the one side of the partition and the carrier which occupies the predetermined position.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
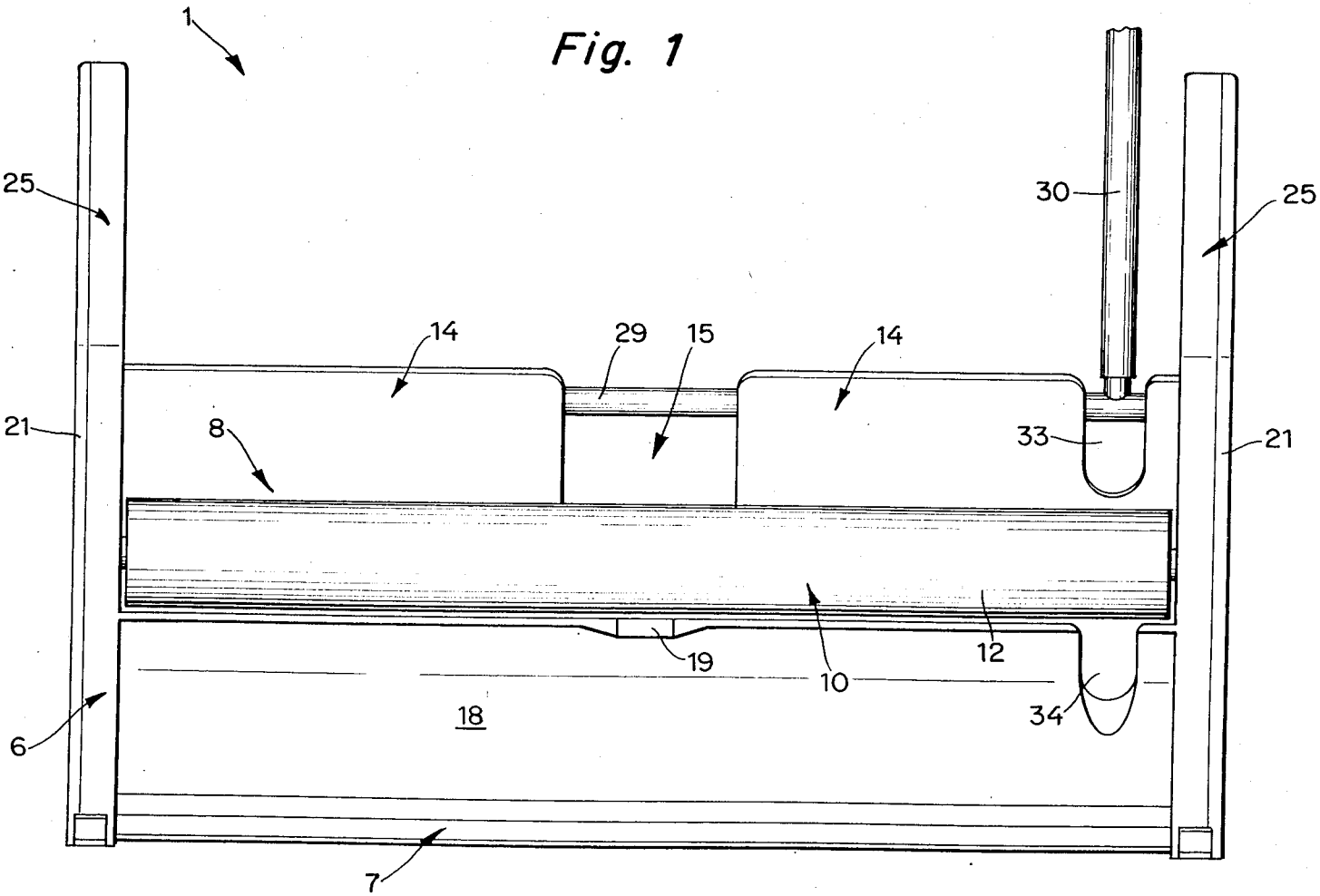
FIG. 1 is a front elevational view of an apparatus which embodies one form of the invention and wherein the wringing means comprises a roller.
Figure 5:
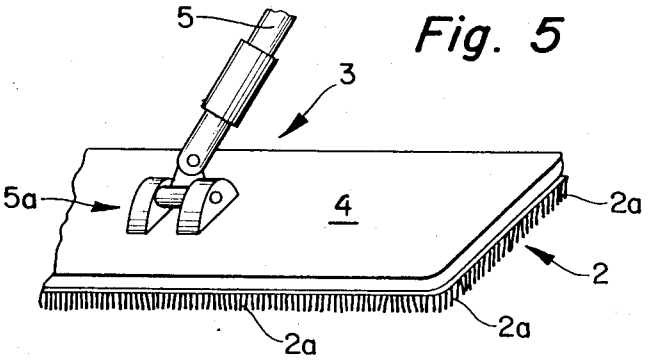
FIG. 5 is a fragmentary perspective view of an implement whose deformable absorbent body can be treatyed in the improved apparatus.

Referring first to FIG. 5, there is shown a portion of an implement 3 which can be treated in the apparatus of the present invention. The implement 3 comprises an elongated rectangular plate-like carrier 4 for a deformable body 2 which readily absorbs liquids and includes a plurality of strands 2*a* extending from one side of the carrier 4. The other side of the carrier 4 is adjacent to, and the carrier is mounted at, one end of an elongated handle 5, e.g., by means of a suitable hinge 5*a* enabling the carrier 4 to pivot about an axis extending in the longitudinal direction of the deformable body 2. If the implement 3 is used as a mop, the strands 2*a* are caused to slide along a wet and dirty floor so that they absorb water as well as the contaminants in the water. The moisture which is absorbed by the strands 2*a* must be expelled at intervals in order to dispose of dirt and other contaminants as well as to enable the deformable body 2 to absorb additional moisture.

The apparatus of the present invention constitutes a wringer which can be used to expel moisture and dirt from the strands 2*a* in a novel and improved way while the carrier 4 is held in a predetermined position (see FIG. 3) in which it is located in a substantially vertical plane and extends horizontally or nearly horizontally. FIGS. 1 to 4 show a first apparatus 1 wherein the means 10 for wringing the deformable body 2 at one side of the plate-like carrier 4 (which then occupies the predetermined position of FIG. 3) comprises an elongated horizontal rotary element in the form of a roller 12 having a larger-diameter median or main portion (note the elastic sleeve 112 and its rigid core 212 of FIG. 2) and two end portions 28 each of which constitutes a stub shaft and which flank the larger-diameter main portion.

Figure 3:
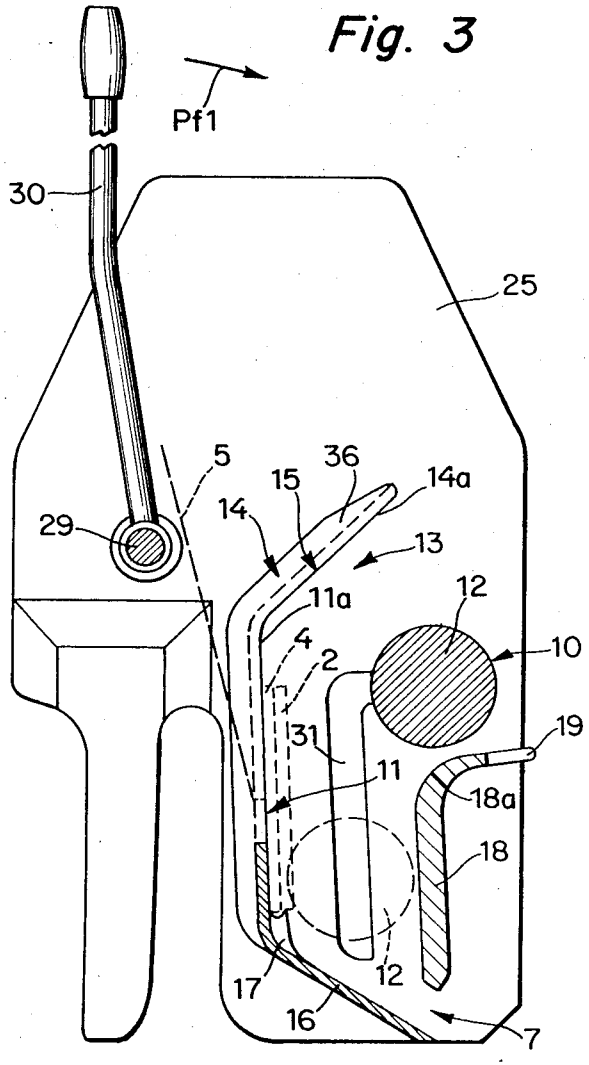
FIG. 3 is a transverse vertical sectional view as seen in the direction of arrows from the line III—III of FIG. 2.

The apparatus 1 comprises a support 6 including a housing having two spaced-apart parallel vertical sidewalls or cheeks 25 which flank the main portion of the roller 12 and are rigidly connected to each other by novel and improved means 8 for locating the carrier 4 in the predetermined position of FIG. 3. The locating means 8 comprises a vertical plate-like first portion 11 (hereinafter called panel for short) whose end portions are rigidly secured to or integral with the respective sidewalls 25 and a lower portion 16 in the form of a chute whose upper side slopes downwardly from the lowermost part of a vertical surface 11*a* of the panel 11. The purpose of the chute 16 is to direct expelled dirty water from the strands 2*a* of the body 2 whose carrier 4 abuts the surface 11*a* of the panel 11 toward and into an outlet 7 which can discharge dirty, water into a bucket or into another collecting receptacle, not shown.

The locating means 8 further includes or is integral with an upper portion 14 constituting a means for guiding the carrier 4 of a mop 3 during introduction into the space adjacent to the side 11*a* of the panel 11. The surface 14*a* of the portion 14 slopes downwardly toward and merges into the upper portion of the surface 11*a*. FIG. 3 shows the roller 12 of the wringing means 10 in its starting position in which such roller and the portion (guiding means) 14 of the locating means 8 define an inclined channel 13 whose orientation is such that the inclination of the carrier 4 of a mop 3 which is being moved toward or away from the predetermined position of FIG. 3 necessarily changes while the carrier advances toward or away from contact with the surface 11*a*. In the apparatus 1 of FIGS. 1 to 4, the orientation of the channel 13 is selected in such a way that the carrier 4 is or can be located in a substantially horizontal plane during the initial stage of insertion into the channel 13 and that the orientation of the carrier 4 thereupon changes from horizontal to vertical during movement toward and thereupon along the surface 11*a* of the panel 11. That side or surface of the panel 11 which faces away from the carrier 4 occupying the predetermined position of FIG. 3 is preferably reinforced by one or more ribs 36 so that the panel 11 can stand pronounced stresses which are likely to arise while the roller 12 is caused to move into contact with successive increments of the deformable body 2 on its way from the starting position of FIG. 3 (such starting position is shown by solid lines) toward a second or lower end position (indicated by broken lines) which the roller 12 assumes upon completion of a wringing operation. In the embodiment of FIGS. 1 to 4, the sleeve 112 of the roller 12 is caused to move into linear contact with successive increments of the deformable body 2 starting at the upper edge face of the carrier 4 and terminating at the lower edge face of such carrier. This ensures that all of the expelled water is compelled to enter the outlet 7 and cannot reach and cannot be reabsorbed by the already treated portions of the strands 2*a*.

The median portion of the means 14 for guiding the carrier 4 on its way toward or away from the predetermined position of FIG. 3 has a slot 15 whose upper end is open and which receives the adjacent portion of the handle 5 so that the handle cannot interfere with movements of the remaining portions 2 and 4 of the implement 3 toward the required positions for engagement of the body 2 by the roller 12. The surfaces bounding the slot 15 can serve to support and guide the adjacent portion of the handle 5 so that the carrier 4 (especially when the deformable body 2 has absorbed a large quantity of water) will automatically descend onto and come to rest on a supporting portion or ledge 17 of the panel 11 as long as the carrier 4 is properly introduced into the channel 13. The ledge 17 can extend along the full length of the panel 11 or it can comprise one or more relatively short sections, e.g., one section at the inner side of each of the sidewalls 25.

The sidewalls 25 have inverted L-shaped passages or slots 31 which define a predetermined path for movements of the roller 12 between its upper and lower end positions. The configuration of the path is such that, when the shafts 28 of the roller 12 are caused to move in the relatively short and substantially horizontal upper portions 31*b* of the respective passages 31, the roller 12 moves toward or away from the panel 11 of the locating means 8. The relatively long vertical portions 31*a* of the passages 31 receive the respective shafts 28 while the roller 12 advances along that (one) portion of its path wherein its peripheral surface is in linear contact with successive increments of the deformable body 2. Thus, the roller 12 is more distant from the vertical surface 11*a* while it moves along a second (upper) portion of its path toward and away from its starting or upper end position which is shown in FIG. 3 by solid lines, and the roller 12 is nearer to the surface 11*a* during travel along the vertical (one) portion of its path. It will be seen that the sidewalls 25 of the housing or frame of the support 6 constitute a means for confining the roller 12 to its movements along the just described path wherein the roller moves downwardly during advancement toward and along the body 2 and wherein the roller 12 must move upwardly in order to reassume the starting position. Such guidance of the roller 12 is desirable and advantageous because the inlet of the channel 13 is relatively wide when the roller dwells in its starting position so that the operator can readily introduce the implement 3 into the support 6 in such a way that the exposed side of the carrier 4 ultimately reaches and contacts the surface 11*a* of the panel 11 whereby the deformable body 2 faces toward the vertical portions 31*a* of the passages 31. Such vertical portions 31*a* are disposed between the panel 11 and a rigid abutment 18 which can be integral with the sidewalls 25 to enhance the stability of the support 6 and along which the roller 12 rolls during expulsion of moisture from the strands 2*a*. The lower portion of the abutment 18 cooperates with the lowermost portion or chute 16 of the locating means 8 to define the aforementioned outlet 7, and the upper portion of the abutment 18 is preferably provided with a centrally located slot 19 in register with the slot 15 to receive (if necessary) a portion of the handle 5 while the carrier 4 and the deformable body 2 occupy the predetermined positions which are shown in FIG. 3 by broken lines. The upper portion of the abutment 18 is preferably curved so that it has a convex surface (at 18*a*) which compels droplets of dirty water descending from the roller 12 (in the upper end position of FIG. 3) to slide therealong and to ultimately enter the outlet 7. The slot 19 can receive a portion of the handle 5 prior to start of the wringing operation as well as during movement of the roller 12 along the deformable body 2, i.e., while the roller 12 rolls along the respective side of the abutment 18. The length of the main portion of the roller 12, of the abutment 18 and of the locating means 8 (including the portions 11, 14 and 16) at least slightly exceeds the length of the longest carrier 4 forming part of an implement which is to be treated in the apparatus 1 of FIGS. 1 to 4.

The means for moving the roller 12 along the path which is defined by the surfaces bounding the passages 31 of the sidewalls (confining means) 25 of the support 6 includes a first unit which is arranged to positively advance the roller 12 from the solid-line starting position of FIG. 3 to the broken-line second end position of FIG. 3, and a second unit including means 35 for yieldably urging the roller 12 back to its starting position. The first unit comprises two substantially dogleg-shaped toothed racks 23 which are movable up and down in elongated vertical guide means 26 of the respective sidewalls 25, a pair of coaxial pinions 24 (each of which can constitute a gear segment) which mate with the rows of teeth on the vertical portions 22 of the respective racks 23, a horizontal shaft 29 which is journalled in the sidewalls 25 and is rigidly connected with the pinions 24, and a lever 30 which, together with the shaft 29, constitutes a means for rotating the pinions 24 in a clockwise or in a counterclockwise direction. When the urging means 35 (e.g., including two coil springs) is free to pull the roller 12 back to its starting position, the vertical legs 22 of the racks 23 transmit torque to the respective pinions 24.

The racks 23 serve as a means for transmitting motion to the shafts 28 of the roller 12 and, to this end, the downwardly sloping second or lower legs 22*a* of these racks are formed with elongated closed slots 27 for the respective shafts 28. The legs 22*a* are preferably adjacent to the outer sides of the respective sidewalls 25 and the inclination of their slots 27 is preferably such that the slots halve the angle between the portions 31*a* and 31*b* of the respective passages 31 in the corresponding sidewalls 25. The springs 35 are preferably at least partially concealed in the corresponding racks 23, and they tend to maintain such racks in their upper end positions (see FIG. 4) in which the lower end of each closed slot 27 is in register with the closed end of the respective portion 31*b* and the upper end of each slot 27 is in register with the corresponding portion 31*a*.

The pinions 24 and the racks 23 are accessible upon removal of plate-like protective shrouds 21 which are secured to the outer sides of the respective sidewalls 25. The reference character 20 denotes in FIG. 4 one-half of the first unit of the moving means for the roller 12, i.e., of that unit which can positively advance the roller along the panel 11 whereby the roller 12 rotates about its axis as a result of linear engagement with the body 2 as well as due to its contact with the respective side of the abutment 18.

The guide means 26 for the vertical legs 22 of the racks 23 are depressions or slots in the corresponding sidewalls 25, and they are preferably aligned with or close to the respective end portions of the panel 11.

Figure 2:
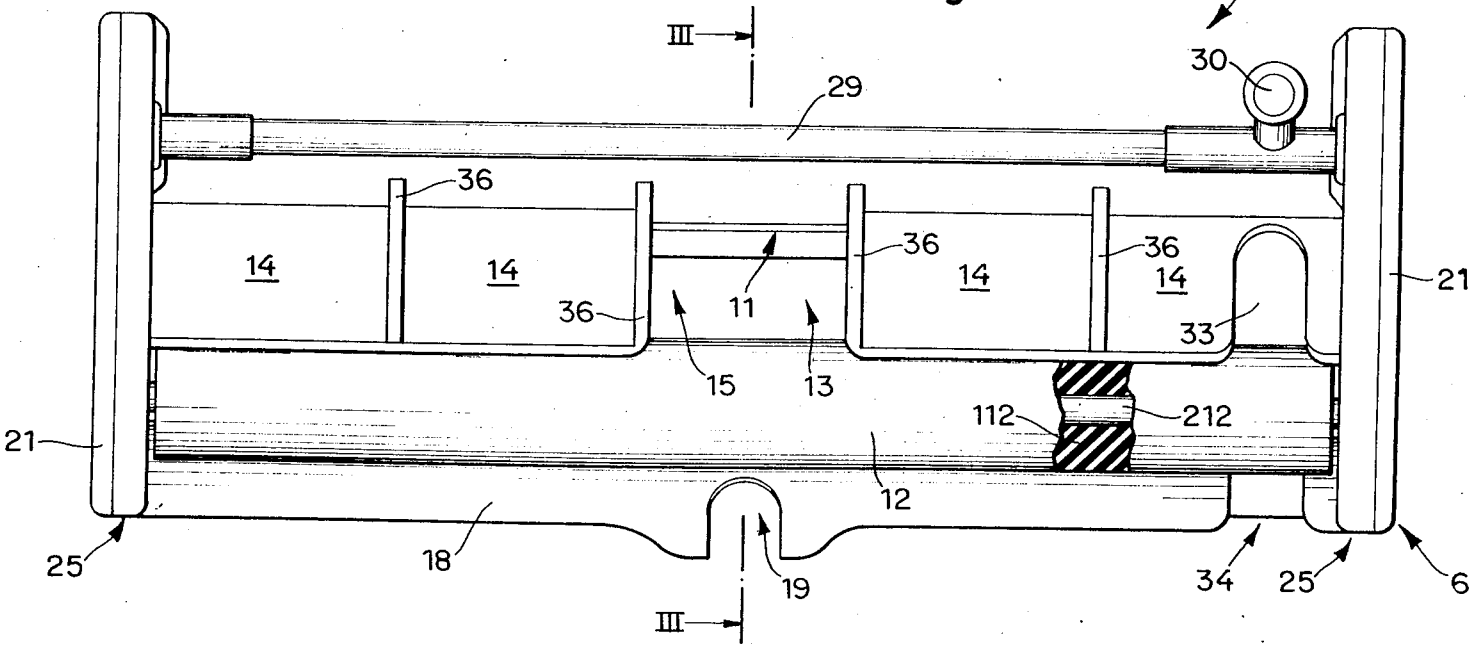
FIG. 2 is a plan view of the apparatus which is shown in FIG. 1.
Figure 4:
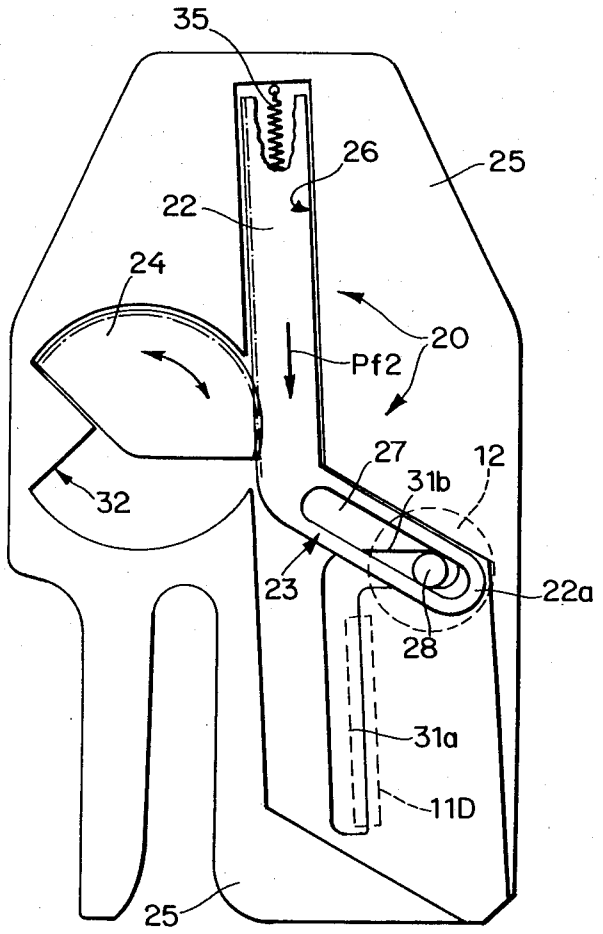
FIG. 4 is an end elevational view of the apparatus, with the shroud at the outer side of the illustrated sidewall of the housing removed.

The mounting of the pinions 24, shaft 29 and lever 30 is preferably such that the lever 30 extends substantially vertically upwardly (see FIG. 3) when the roller 12 is held in its starting position, and that the lever 30 is substantially horizontal when the roller 12 comes into contact with the deformable body 2, i.e., when the shafts 28 leave the horizontal portions 31*b* and enter the vertical portions 31*a* of the respective passages 31. The direction in which the lever 30 is pivoted in order to compel the roller 12 to leave its starting position is indicated by the arrow Pf1 (FIG. 2). The racks 23 are then caused to move downwardly (see the arrow Pf2 in FIG. 4) against the opposition of the coil springs 35. Such downward movement of the racks 23 entails a horizontal movement of the shafts 28 (which extend into the respective closed slots 27), first in a direction to the left as viewed in FIG. 4, and thereupon vertically downwardly. The roller 12 is held in linear contact with successive horizontally extending increments of the deformable body 2 and expels water and impurities toward the outlet 7. The force with which the lever 30 must be rotated in order to wring the strands 2*a* of the body 2 is relatively small so that the apparatus 1 can be readily manipulated by a relatively small and weak person. The length of the lever 30 can be fixed or can be varied.

The pinions 24 engage suitable stops 32 on the corresponding sidewalls 25 as soon as the roller 12 reaches its lower end position. As mentioned above, the construction of the first unit of the means for moving the roller 12 along its path is preferably such that the lever 30 is horizontal or nearly horizontal when the peripheral surface of the roller 12 reaches the topmost portion of the deformable body 2 in the support 6. This is particularly desirable and advantageous if the apparatus 1 is installed on a wheel-mounted receptacle (not shown) which would be likely to be tilted and to overturn if the roller 12 were to engage the deformable body 2 before the lever 30 reaches or approaches a substantially horizontal position. The portion 14 of the locating means 8 is preferably provided with a recess or cutout 33 for a portion of the lever 30, and a similar recess or cutout 34 is preferably provided in the abutment 18 in register with the cutout 33 to receive a portion of the lever 30, i.e., to guarantee that the lever 30 can be pivoted through an angle which is necessary to ensure that the roller 12 can reach its lower end position.

The reinforcing rib or ribs 36 can be provided at one side of the panel 11 as well as at the corresponding side of the portion 14 and/or portion 16. Such rib or ribs render it possible to reduce the thickness of the major portions of the locating means 8 and to thus reduce the weight and cost of the apparatus.

The apparatus 1 can further comprise means for yieldably biasing the roller 12 against the deformable body 2 while the shafts 28 are caused to move downwardly in the vertical portions 31*a* of the respective passages 31. The biasing means can comprise springs and/or one or more elastic cushions. One such cushion is shown at 110 in FIG. 4; its purpose is to urge the roller 12 into linear contact with the body 2 and to thus ensure that the inclination of the roller 12 can undergo certain minor changes (the maximum changes of inclination of the roller 12 are determined by the width of the portions 31*a* of the passages 31 and by the diameters of the shafts 28). Changes in inclination of the roller 12 relative to the carrier 4 which occupies the predetermined position of FIG. 3 are desirable in order to ensure an even more uniform expulsion of moisture from the strands 2*a*, e.g., to compensate for absence of uniform thickness of the body 2 and/or carrier 4. If the apparatus 1 comprises the yieldable biasing means 110 or analogous biasing means, the roller 12 can constitute a one-piece body made of a rigid metallic or plastic material. Such biasing means can be used in lieu of or in addition to a roller which includes an elastic portion. This is shown in FIG. 2 wherein a portion of the roller 12 is broken away to indicate that such roller comprises the aforementioned rigid core or shaft 212 whose end portions are connected to or integral with the shafts 28, and the elastic sleeve 112 which surrounds the core 212 and whose peripheral surface rolls along the abutment 18 while being held in linear contact with successive horizontally extending portions or increments of the deformable body 2. It is even possible to make the entire roller 12 of an at least slightly elastic material, such as rubber. As a rule, the roller 12 will be rigid or will comprise a rigid core and an elastic sleeve as shown in FIG. 2.

The establishment of mere linear contact between the roller 12 and the deformable body 2 is desirable because this results in the application of rather pronounced deforming forces which, in turn, ensure the expulsion of a surprisingly high percentage of moisture from the strands 2*a* during a single pass of the roller 12 along that (one) portion of its path which is defined by the surfaces bounding the vertical portions 31*a* of the passages 31. Moreover, such linear contact between the roller 12 and the deformable body 2 even more reliably compels the expelled liquid to descend toward and into the outlet 7, together with a high percentage of impurities. Still further, and as mentioned above, the means for positively moving the roller 12 can be operated with the exertion of a relatively small force which is of particular importance to a person whose occupation involves full time cleaning, mopping, wiping or sweeping of floors, walls, ceilings and the like.

Figure 6:
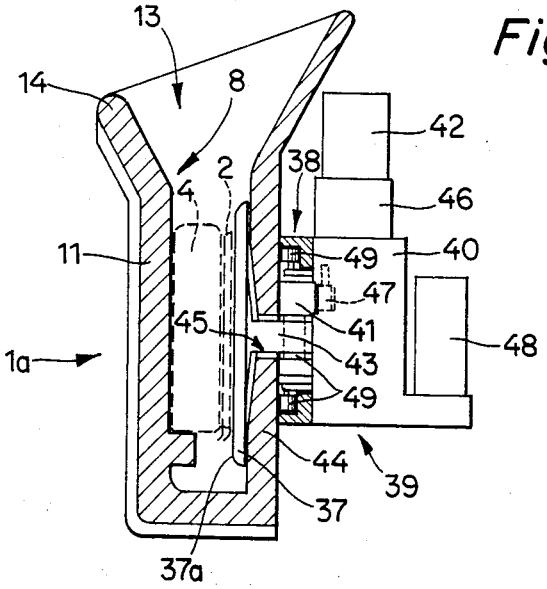
FIG. 6 is a transverse vertical sectional view of a second apparatus wherein the wringing means comprises a blade.
Figure 7:
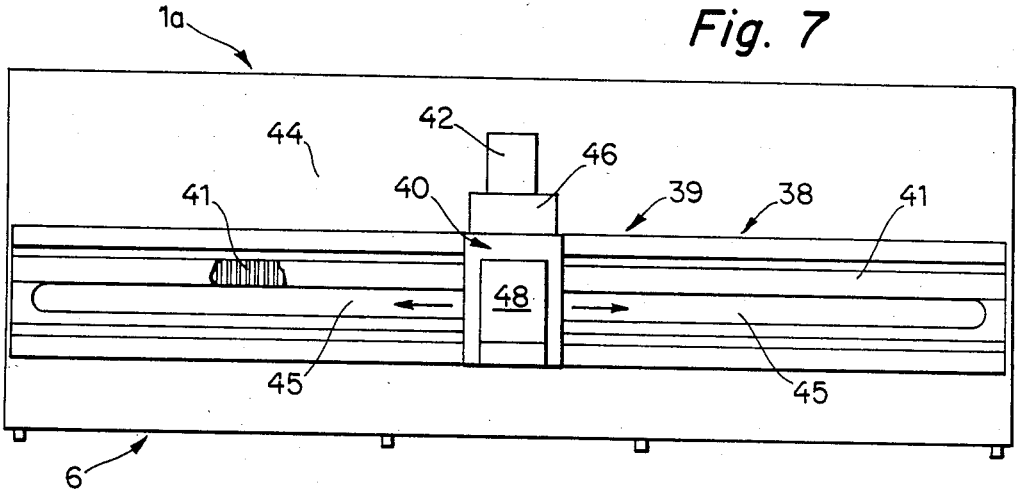
FIG. 7 is a rear elevational view of the second apparatus as seen from the right-hand side of FIG. 6.
Figure 8:
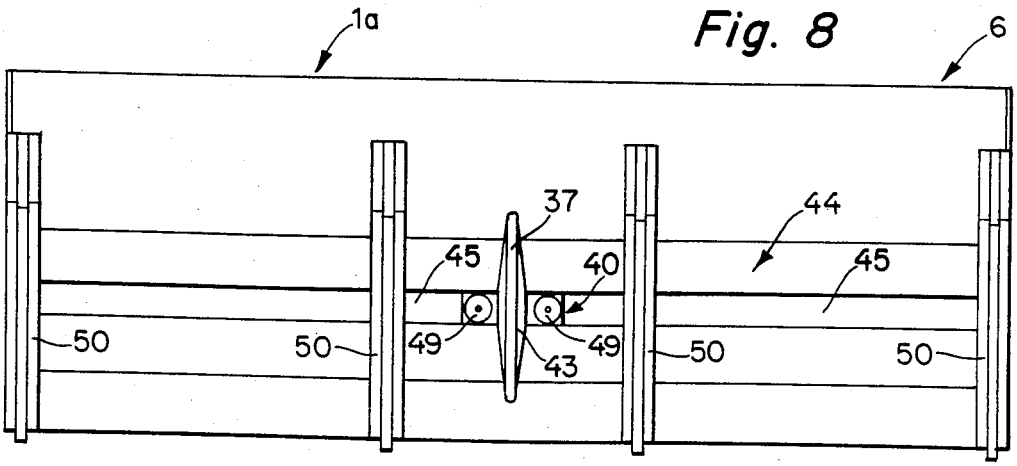
FIG. 8 is a front elevational view of the second apparatus.

FIGS. 6 to 8 illustrate a modified apparatus 1*a* wherein the means for moving the wringing means relative to the deformable body 2 on a carrier 4 which is held in the predetermined position of FIG. 6 includes a prime mover 39 including a reversible electric motor 42. Furthermore, the wringing means includes a substantially vertically extending and relatively short deforming member in the form of a doctor-like blade 37 having a vertical edge 37*a* which is in linear contact with the strands of the body 2 while the prime mover 39 moves the deforming member 37 in a direction to the left or to the right, as viewed in FIG. 8. The means for defining an elongated horizontal path for the deforming member 37 includes an elongated horizontal guide 38 which is parallel with the carrier 4 for the deformable body 2 when the carrier assumes the predetermined position of FIG. 6. The means 8 for locating the carrier 4 in such position is or can be substantially identical with the similarly referenced locating means of FIGS. 1–4.

The prime mover 39 can move the deforming member 37 to at least one end position in which the deforming member is adjacent to the one or the other longitudinal end of the carrier 4 so that the latter can be readily inserted into or withdrawn from the housing of the support 6. The latter includes an abutment for the blade 37 in the form of an elongated vertical partition 44 having a first side facing toward the panel 11 of the locating means 8 and a second side facing to the right, as viewed in FIG. 6. The second side of the partition 44 is adjacent to the major part of the prime mover 39 which includes the reversible electric motor 42 whose output shaft (not specifically shown) drives the input element of a suitable simple transmission 46 (e.g., a set of mating gears). The output element of the transmission 46 drives a pinion 47 in mesh with an elongated horizontal toothed rack 41. The rack 41 is mounted on the partition 44 adjacent to an elongated horizontal slot 45 for a portion 43 of a carriage 40 which supports the motor 42, the transmission 46 an the deforming member 37. The latter is located between the partition 44 and the panel 11.

When the motor 42 is on, the transmission 46 drives the pinion 47 in a clockwise or in a counterclockwise direction so that the carriage 40 is compelled to move along the partition 44 in the longitudinal direction of the slot 45. The guide means 38 engages with and confines the carriage 40 to movement along a horizontal path in the longitudinal direction of the carrier 4 and of the deformable body 2 in the support 6. The guide means 38 comprises two elongated L-shaped rails which are mirror symmetrical to each other and are disposed at the opposite sides of the slot 45, i.e., at a level above and at a level below the slot. The carriage 40 has a first set of roller followers 49 which are disposed between the respective side of the partition 44 and the downwardly extending leg of the upper rail of the guide means 38, as well as similar roller followers which cooperate with the upwardly extending leg of the lower rail. Additional roller followers 49 on the portion 43 of the carriage 40 extend into and are guided by the surfaces bounding the slot 45 (see FIG. 8). Such additional roller followers 49 flank the deforming member 37.

The blade-like deforming member 37 can be replaced with a vertically extending roller (not specifically shown) whose end portions are rotatably journalled in the carriage 40. The length of such roller (or of the edge 37*a* of the illustrated deforming member 37) need not appreciably exceed the width of the carrier 4 and of the deformable body 2. The partition 44 can be reinforced by vertical ribs 50 which are spaced apart from one another and do not interfere with the flow of expelled liquid into the outlet of the support 6. The ribs 50 are rigid with the lower portion of the partition 44 and constitute parts of the panel 11.

The support 6 can be mounted on a bucket or another receptacle for dirty water which is expelled from the strands 2*a* of the deformable body 2.

The carriage 40 preferably further supports an energy source 48 for the electric motor 42. The illustrated source 48 is a rechargeable battery or a set of two or more batteries. The overall energy storing capacity of the battery or batteries 48 can be selected practically at will and should suffice to allow for operation of the apparatus 1*a* for a reasonable period of time. The dimensions of the carriage 40 can be increased to provide room for a larger battery or for a larger number of batteries. It is equally possible to place the energy source next to the apparatus 1*a* or to mount the battery or batteries on the support 6 and connect such stationary battery or batteries with the motor 42 by means of a flexible cable. The carriage 40 can further support portions of one or more limit switches which cooperate with suitable trips on the support 6 to arrest and reverse the motor 42 when the carriage reaches the one or the other end of its stroke.

The liquid which is expelled by the edge 37*a* flows downwardly along both sides of the deforming member 37 and enters the outlet of the support 6.

An advantage of the apparatus 1*a* is that its operation does not involve the application of any force. All the operator has to do is to manipulate the implement including the carrier 4 and the deformable body 2 and to start the motor 42. The latter can be arrested in automatic response to completion of a wringing operation.

Both illustrated embodiments of the improved apparatus exhibit the advantage that the expulsion of a very high percentage of moisture from the deformable body 2 can be carried out with a much higher degree of predictability than in heretofore known wringers. Moreover, the expulsion of impurities from the strands of the deformable body 2 or from portions of a different deformable body is also more predictable and the treated implement does not entrain any of the previously expelled impurities. The utilization of a deforming member which constitutes or comprises one or more rollers (e.g., a row of two or more coaxial rollers) is desirable and advantageous, especially in the apparatus of FIGS. 1–4, because such deforming member can be moved back and forth with the exertion of a relatively small force. On the other hand, a blade-like deforming member is much more likely to be held in a more linear contact with the deformable body so that it can apply to the adjacent portions of the deformable body a very pronounced wringing force. Another advantage of a deforming member which includes one or more rotary elements is that it is less likely to damage or cause extensive wear upon the deformable body of the implement 3 or an analogous implement. This will be readily appreciated by bearing in mind that the rotary element is in a mere rolling contact with the deformable body.

The utilization of locating means which ensures that the normally substantially plate-like carrier 4 is maintained in or close to a vertical plane is desirable and advantageous because the deforming member is much more likely to allow for practically unimpeded gravitational descent of expelled liquids into the outlet of the support 6 regardless of whether the deforming member is reciprocated horizontally (as shown in FIGS. 6–8) or is caused to move from an upper level toward a lower level during expulsion of moisture from the deformable body.

The provision of the aforediscussed channel 13 ensures that the orientation or inclination of the implement 3 changes automatically during insertion of the carrier into the support 6, i.e., that the carrier is compelled to leave its normal position (in a substantially horizontal plane) and to assume the predetermined position (in a vertical plane) of FIGS. 3 or 6. The location of the hinge 5*a* for the carrier 4 is normally such that, when the handle 5 is caused to lift the carrier off the floor, the carrier automatically assumes or comes close to a position in which it is located in a horizontal plane. As mentioned above, the width of the channel 13 preferably increases in a direction toward the inlet; this ensures that the carrier 4 can find its way toward the predetermined optimum position for engagement of the deformable body 2 by the deforming member 12 or 37 even if the carrier 4 is not inserted into the housing of the support 6 in an optimum position for introduction into engagement with the respective vertical surface of the panel 11.

The entire apparatus can be made of a suitable synthetic plastic material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for expelling moisture from mops and like implements wherein a carrier comprises a plate which supports a body of deformable absorbent material, comprising a support including means for locating the carrier of an implement in a predetermined position, said locating means comprising means for maintaining the carrier which occupies said position in a substantially vertical plane; wringing means movably carried by said support; and means for moving said wringing means along a predetermined path relative to the carrier in said position so that the wringing means is maintained in a substantially linear contact with and deforms successive increments of the body on such carrier during movement along at least one portion of said path.

2. The apparatus of claim 1 for expelling moisture from implements wherein the plate of the carrier has a first side and a second side adjacent to the body of deformable absorbent material, further comprising an abutment for said wringing means, said wringing means being disposed between said abutment and the body on the carrier occupying said predetermined position during movement along said one portion of said path.

3. The apparatus of claim 1, wherein said wringing means comprises at least one rotary element whose axis extends substantially transversely of said path, said moving means including means for rolling said element along the deformable body during movement along said portion of said path.

4. The apparatus of claim 1, wherein said one portion of said path is substantially vertical.

5. The apparatus of claim 1, wherein said support further includes a housing and said locating means is installed in said housing, and further comprising means for guiding a carrier during manual insertion into said housing on the way toward said predetermined position.

6. The apparatus of claim 1, wherein said path includes a second portion and said wringing means is respectively nearer to and more distant from said locating means during movement along said one portion and said second portion of said path.

7. The apparatus of claim 6, wherein said second portion of said path is located at a level above said one portion.

8. The apparatus of claim 1 for expelling moisture from implements having carriers of predetermined length, wherein said wringing means is elongated and its length at least matches said predetermined length, said wringing means having first and second end portions and said support further including means for confining the end portions of said wringing means to movements along said path.

9. The apparatus of claim 8, wherein said confining means has passages for the end portions of said wringing means.

10. The apparatus of claim 9, wherein the end portions of said wringing means include shafts and said moving means includes means for transmitting motion to the shafts of said wringing means.

11. The apparatus of claim 10, wherein said motion transmitting means comprises at least one toothed rack and said moving means further comprises a pinion rotatably mounted in said support and mating with said rack, and means for rotating said pinion.

12. The apparatus of claim 11, wherein said confining means includes two spaced-apart substantially upright sidewalls and said wringing means further includes a main portion between said end portions, said shafts extending outwardly through the passages of said sidewalls and said motion transmitting means comprising two toothed racks outwardly adjacent to the respective sidewalls and having closed slots for the shafts of the respective end portions of said wringing means.

13. The apparatus of claim 12, wherein said moving means comprises two pinions, one for each of said racks, and the means for rotating said pinions includes a further shaft which is rigid with said pinions and is rotatably mounted in said sidewalls and means for rotating said further shaft.

14. The apparatus of claim 13, wherein said means for rotating comprises a lever.

15. The apparatus of claim 12, wherein each of said racks includes a substantially vertical first leg which is provided with a row of teeth and a second leg which is inclined relative to and is located at a level below the first leg, said closed slots being provided in the second legs of said toothed racks, and further comprising guide means for the first legs of said racks.

16. The apparatus of claim 15, wherein said guide means have substantially upright guides for the first legs of said racks and each of said passages has the shape of an inverted L with a shorter substantially horizontal upper portion and a substantially vertical and longer lower portion, each of said shorter portions having a closed end remote from the respective longer portion and each of said slots having a lower end portion which is in substantial register with the closed end of the respective shorter first portion and an upper end portion which is in substantial register with the respective longer portion while the corresponding toothed rack is held in an upper end position.

17. The apparatus of claim 16, wherein said closed slots are elongated and extend at angles of substantially 45 degrees to the shorter and longer portions of the respective passages.

18. The apparatus of claim 12, wherein said moving means comprises two pinions, one for each of said racks, a substantially horizontal further shaft rigid with said pinions and journalled in said sidewalls, and a lever for rotating said further shaft, said path including a second portion along which said wringing means moves toward engagement with the deformable body of a carrier in said position and said wringing means being movable to and from a starting position in which it is located at one end of said second path portion remote from said one path portion, said lever being substantially vertical when said wringing means is held in said starting position and said lever being substantially horizontal when said wringing means enters said one portion of said path.

19. The apparatus of claim 1, further comprising means for yieldably biasing said wringing means against the deformable body on the carrier occupying said position while said wringing means is located in said one portion of said path.

20. The apparatus of claim 1, wherein said wringing means comprises an elastic portion which contacts the deformable body on the carrier occupying said predetermined position while said wringing means is located in said one portion of said path.

21. The apparatus of claim 20, wherein said wringing means comprises a roller including a rigid core and said elastic portion is a sleeve surrounding said core.

22. The apparatus of claim 1, wherein said path is elongated and said moving means includes means for positively moving said wringing means from one end toward the other end of said path and means for yieldably urging said wringing means toward said one end of said path.

23. The apparatus of claim 22, wherein said one end of said path is located at a level above said other end of said path and said urging neans comprises at least one spring.

24. The apparatus of claim 23, wherein said means for positively moving comprises at least one toothed rack and said spring is at least partially confined in said rack.

25. The apparatus of claim 1, wherein said locating means includes at least one reinforcing portion.

26. The apparatus of claim 25, wherein said locating means has a first side which is contacted by the carrier occupying said position and a second side, said reinforcing means comprising at least one rib at the second side of said locating means.

27. The apparatus of claim 1, wherein said support further includes a housing for said locating means and said locating means comprises a portion on which the carrier of an implement comes to rest while occupying said predetermined position.

28. The apparatus of claim 1, wherein said wringing means comprises a substantially blade-like deforming member having an edge portion which deforms and moves along the deformable body on the carrier occupying said predetermined position.

29. The apparatus of claim 1, wherein said moving means comprises a prime mover.

30. The apparatus of claim 29, wherein said prime mover comprises an electric motor and further comprising an energy source for said motor.

31. The apparatus of claim 30, wherein said energy source comprises a rechargeable battery.

32. The apparatus of claim 1, wherein said moving means includes a carriage for said wringing means and means for reciprocating said carriage along said path.

33. The apparatus of claim 32, wherein said support includes a partition having a first side facing said locating means and a second side, said partition further having an elongated slot and said moving means including a prime mover disposed at the second side of said partition, said carriage being driven by said prime mover, extending through said slot and supporting said wringing means intermediate the first side of said partition and said locating means.

34. Apparatus for expelling moisture from mops and like implements wherein a carrier comprises a plate having a first side and a second side and supports a body of deformable absorbent material at the second side thereof, comprising a support including means for locating the carrier of an implement in a predetermined position; wringing means movably carried by said support; means for moving siad wringing means along a predetermined path relative to the carrier in said position so that the wringing means is maintained in substantially linear contact with and deforms successive increments of the body on such carrier during movement along at least a portion of said path; and an abutment for guiding send means for moving said wringing means, along said portion of said path said wringing means being disposed between said abutment and by the body of the carrier occupying said predetermined position during movement along said one portion of said path.

35. Apparatus for expelling moisture from mops and like implements wherein a carrier supports a body of deformable absorbent material, comprising a support including a housing and means in said housing for locating the carrier of an implement in a predetermined position; means for guiding a carrier during manual insertion into said housing on the way toward said predetermined position; wringing means movably carried by said support; and means for moving said wringing means along a predetermined path relative to the carrier in said position so that the wringing means is maintained in substantially linear contact with and deforms successive increments of the body on such carrier during movement along at least one portion of said path.

36. The apparatus of claim 35 for expelling moisture from implements wherein the carrier includes a plate, wherein said locating means includes means for maintaining the carrier which occupies said position in a substantially vertical plane.

37. The apparatus of claim 35, wherein said means for guiding is integral with said locating means.

38. The apparatus of claim 35, wherein said wringing means is movable to and from a starting position in which said wringing means and said means for guiding define a channel wherein an implement is advanced in order to locate its carrier in said predetermined position.

39. The apparatus of claim 38, wherein the orientation of said channel is such that the inclination of the carrier changes on its way toward said predetermined position.

40. The apparatus of claim 35, wherein said locating means has a substantially vertical exposed surface which is contacted by the carrier in said predetermined position and said means for guiding has a second surface which is located at a level above and slopes downwardly toward said exposed surface.

41. The apparatus of claim 35, expelling moisture from implements wherein the carrier is connected to one end of an elongated handle, said means for guiding having a slot for reception of the handle while the corresponding carrier is maintained in said predetermined position.

42. The apparatus of claim 41, wherein said locating means and said means for guiding are elongated, said slot being disposed substantially midway between the ends of said means for guiding, and having an open upper end.

43. Apparatus for expelling moisture from mops and like implements wherein a carrier supports a body of deformable absorbent material, comprising a support including means for locating the carrier of an implement in a predetermined position; wringing means movably carried by said support, said wringing means comprising a substantially blade-like deforming member having an edge portion which deforms and moves along the deformable body on the carrier occupying said predetermined position; and means for moving said wringing means along a predetermined path relative to the carrier in said position so that the edge portion of said deforming member is maintained in substantially linear contact with and deforms successive increments of the body on such carrier during movement along at least one portion of said path.

44. The apparatus of claim 43 for expelling moisture from implements wherein an elongated carrier has end portions which are located substantially at the same level while occupying said predetermined position, said moving means including means for moving said deforming member substantially horizontally from one end toward the other end of the carrier occupying said position.

45. The apparatus of claim 43 for expelling moisture from deformable bodies of implements wherein the deformable body has a predetermined width, said edge portion having a length which at least approximates said predetermined width.

46. Apparatus for expelling moisture from mops and like implements wherein a carrier supports a body of deformable absorbent material, comprising a support including means for locating the carrier of an implement in a predetermined position and a partition having a first side facing said locating means and a second side, said partition further having an elongated slot; wringing means movably carried by said support; and means for moving said wringing means along a predetermined path relative to the carrier in said position so that the wringing means is maintained in substantially linear contact with and deforms successive increments of the body on such carrier during movement along at least one portion of said path, said moving means including a carriage for said wringing means and means for reciprocating said carriage along said path, said reciprocating means comprising a prime mover disposed at the second side of said partition and said carriage being driven by said prime mover, extending through said slot and supporting said wringing means intermediate the first side of said partition and said locating means.

47. The apparatus of claim 46, wherein said moving means further comprises an elongated toothed rack extending along said slot and said motor is movable along the second side of said partition and has a rotary output element and a pinion receiving torque from said output element and mating with said rack, said carriage being arranged to share the movements of said motor.

48. The apparatus of claim 47, wherein said moving means further comprises a transmission interposed between said output element and said pinion.

* * * * *